US008991667B2

(12) United States Patent
Perez

(10) Patent No.: US 8,991,667 B2
(45) Date of Patent: Mar. 31, 2015

(54) BACKPACK SYSTEM WITH ASSOCIATED TENT

(71) Applicant: Ed B. Perez, Granada Hills, CA (US)

(72) Inventor: Ed B. Perez, Granada Hills, CA (US)

( * ) Notice: Subject to any disclaimer, the term of this patent is extended or adjusted under 35 U.S.C. 154(b) by 218 days.

(21) Appl. No.: 13/672,492

(22) Filed: Nov. 8, 2012

(65) Prior Publication Data

US 2014/0124548 A1 May 8, 2014

(51) Int. Cl.
*A45F 4/04* (2006.01)

(52) U.S. Cl.
CPC ..... *A45F 4/04* (2013.01)
USPC ..... 224/154; 135/95; 135/137; 5/418

(58) Field of Classification Search
CPC ..... A45F 4/04
USPC ..... 224/154; 135/95, 96, 116–118, 127, 135/136–138, 156, 905–906; 5/112–117, 5/417–420
See application file for complete search history.

(56) References Cited

U.S. PATENT DOCUMENTS

| | | | | | |
|---|---|---|---|---|---|
| 2,771,087 | A * | 11/1956 | Simonson | 135/126 |
| 3,931,918 | A * | 1/1976 | Smith et al. | 224/154 |
| 4,239,135 | A * | 12/1980 | Armstrong | 224/154 |
| 4,883,206 | A * | 11/1989 | Miller | 224/153 |
| 4,885,812 | A * | 12/1989 | Lindner | 5/113 |
| 5,078,096 | A * | 1/1992 | Bishop et al. | 119/497 |
| 5,277,349 | A * | 1/1994 | Rowe | 224/154 |
| 5,595,203 | A * | 1/1997 | Espinosa | 135/124 |
| 7,810,514 | B2 * | 10/2010 | Lah | 135/120.3 |
| 2005/0258294 | A1 * | 11/2005 | Dickson | 242/388.3 |
| 2008/0237281 | A1 * | 10/2008 | Robinson | 224/154 |
| 2011/0297200 | A1 * | 12/2011 | Price et al. | 135/126 |

* cited by examiner

*Primary Examiner* — Justin Larson
*Assistant Examiner* — Scott McNurlen
(74) *Attorney, Agent, or Firm* — James A. Italia; Italia IP

(57) ABSTRACT

A combined backpack and tent, optionally including a ground mat for sleeping on. The ground mat connects at its corners to several lightweight spars which once assembled define an arcuate skeletal frame above the ground mat. A tent fabric may then be supported on the skeletal frame. The spars and optional tethers hold the skeletal frame in shape by tension. The spars are knock-down, comprising manually connectable and separable sections which when disassembled fit into the backpack.

7 Claims, 7 Drawing Sheets

BACKPACK SYSTEM WITH ASSOCIATED TENT

REFERENCE TO RELATED APPLICATION

This application claims priority of application Ser. No. 61/557,373, filed Nov. 8, 2011.

BACKGROUND OF INVENTION

This application relates generally to backpack systems and more particularly to backpack systems including sleeping pads and shelters such as tents.

Backpacks are commonly used to conveniently carry around items in a variety of environments and scenarios such as camping, school, military, etc. Backpacks are typically not large enough or configured to also carry things such as sleeping pads, sleeping bags, pillows and the like. It would be advantageous to have available a backpack capable of supporting sleeping items and items of shelter.

SUMMARY

The present invention provides a backpack which in addition to providing the usual functions of a backpack, supports additional functions extending to accommodating sleeping and providing shelter. Shelter is provided by a tent having a skeletal frame and fabric supported on the skeletal frame. A ground pad is also provided.

Elements of the skeletal pad may be manually assembled and disassembled, and contained within the backpack when disassembled. The backpack may incorporate elements to assist in holding the skeletal frame in operable position, and may removably fasten to the ground mat.

The skeletal frame is quite lightweight and minimal in bulk and structure. When assembled, it holds its form against spontaneous collapse by tension, providing a deformable shape for supporting the tent fabric in an elevated condition to define an occupiable space therewithin.

While tents can obviously serve general and civilian purposes, the present combination of backpack and tent is regarded as highly advantageous for military purposes. The tent and ground mat are compact, light weight, and readily contained within the backpack, which may also carry other items. The tent is adjustable as to the degree of exposure of an occupant to the exterior. This characteristic offers versatility in use, such as exposing the interior to a greater or lesser extent for purposes of surveillance, concealment, accommodation of weaponry for sniping purposes, and the like.

It is an object of the invention to provide a light weight, practical tent which may be carried about in an associated backpack.

Another object of the invention is to provide a shelter having minimal weight and bulk.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
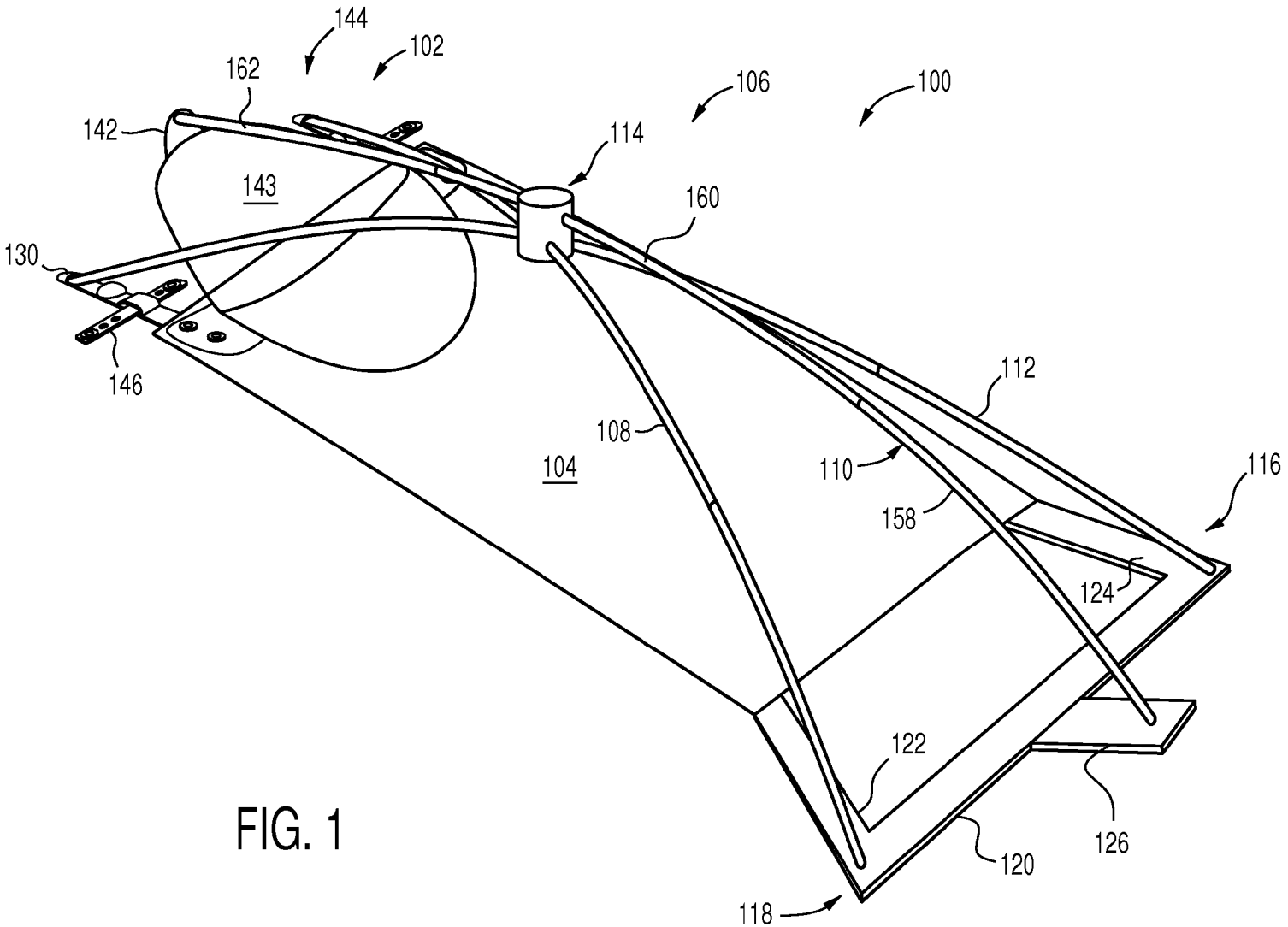
FIG. 1 is a perspective view of the backpack and tent frame of a backpack system according to at least one aspect of the invention.
Figure 4:
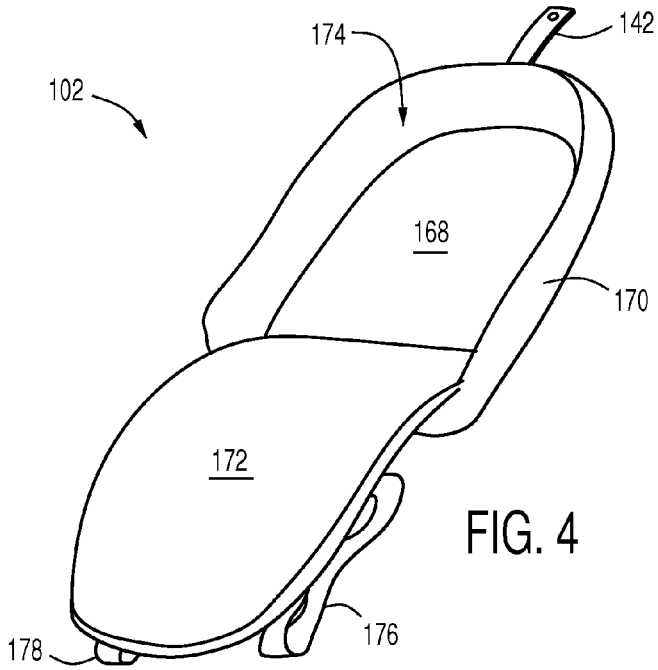
FIG. 4. is a detail view of a backpack seen towards the left of FIG. 1.
Figure 5:
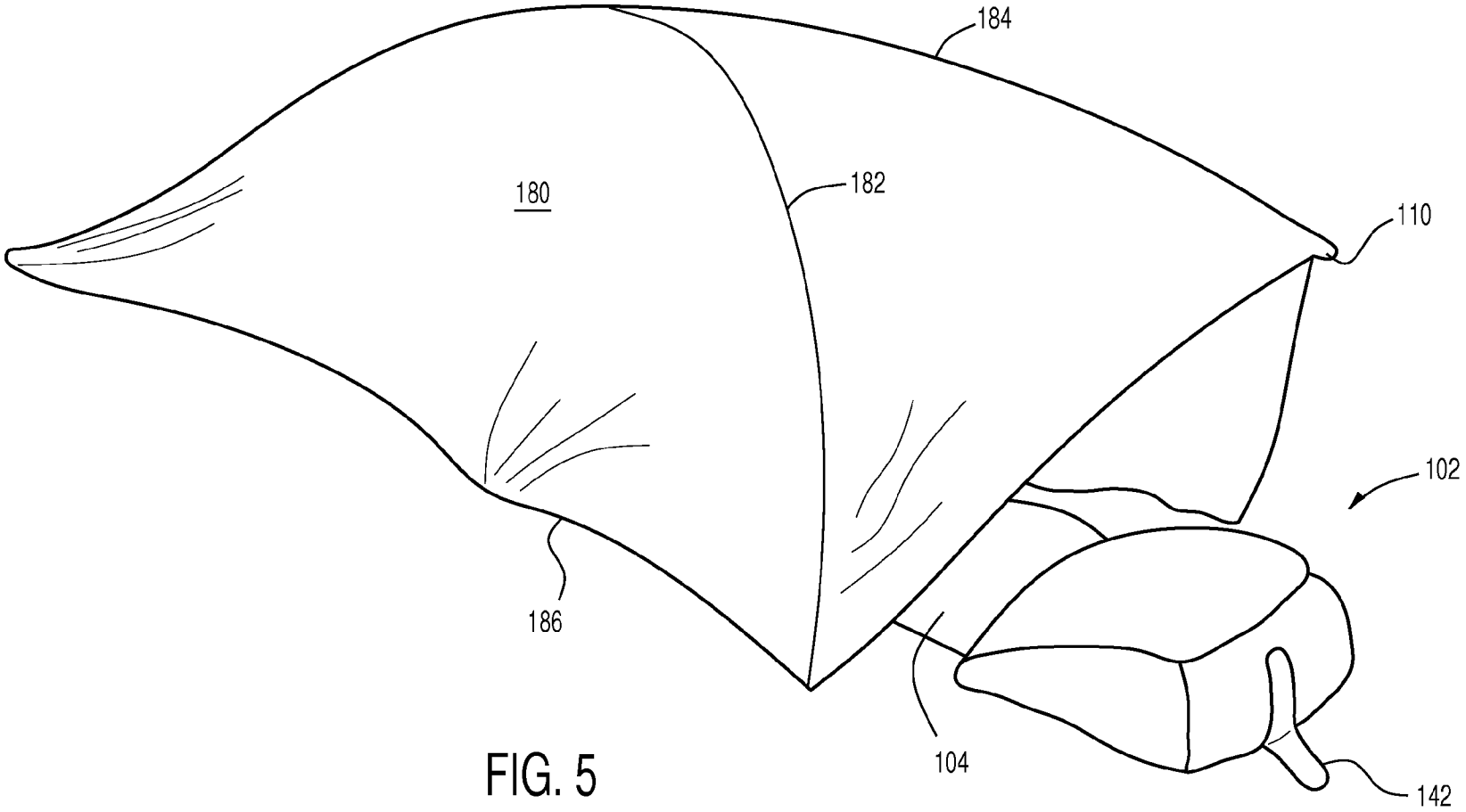
FIG. 5 is a perspective view of the backpack system of FIG. 1, showing a tent member installed.

FIG. 1 shows a backpack system 100 comprising a backpack 102, a ground mat 104, and a knock-down skeletal frame 106 which will be used to support a fabric tent member 180, seen in FIG. 5. It should be recognized that the backpack system 100 is convertible between a first configuration serving as a backpack and a second configuration serving as a tent, as will be further explained as description of the invention progresses. When configured as a backpack, the backpack system 100 may comprise a plurality of flaccid walls, as best seen in FIG. 4. In the tent configuration, the backpack system includes a ground mat 104, and which may either be integral with or preferably manually connectable to and removable or detachable from the backpack components. Attachment of the ground mat 104 may be accomplished using a zipper, snaps, hook and loop fastening material, or other common attachment devices.

The skeletal frame 106 may comprise a first spar 108, a second spar 110, and a third spar 112. Each one of the first spar 108, second spar 110, and third spar 112 may be made from segments which connect serially to one another to form one elongated spar member. As seen in FIG. 1, each one of the first spar 108, second spar 110, and third spar 112 is arcuate when assembled. This arcuate configuration may be built into the individual spar, such as by making each segment rigid and arcuate. Alternatively, arcuate configuration of the spars 108, 110, 112 may result from fabricating the spars 108, 110, 112 in single or plural connectable segments which are slightly flexible, with curvature arising from cumulative axial misalignment of the individual segments. The first spar 108, second spar 110, and third spar 112 collectively form the skeletal frame 106 and its characteristic curved upper surface. This surface is better understood when viewing how a tent fabric member is draped over the first spar 108, second spar 110, and third spar 112, as seen in Fig. However, before discussing the completed or nearly completed tent, stabilization of the skeletal frame 106 will be discussed.

In summary, the arcuate shape collectively defined by the members of the skeletal frame 106 may be the result of tension forces imposed on the individual of first spar 108, second spar 110, and third spar 112, together with a fastener such as a clamp 114 which gathers the first spar 108, second spar 110, and third spar 112 where the first spar 108, the second spar 110, and the third spar 112 cross one another at a common point at the maximum height of each. The outer first spar 108 may be coupled to a frame 116, such as by fixing the end of the first spar 108 at a corner 118 of the frame 116 in any suitable way. The spar 110 occupies a plane which generally intersects the longitudinal axis of the ground mat 104 when the spar 110 is in its operative position fixed to the receptacle at its first end and its second end. By contrast, the spars 108, 112 are connected at their respective first end and second end at corners of the ground mat 104.

Each spar 108, 110, or 112 may comprise a first end and a second end and forms an arc when the first end and the second end of the spar are fixed to the receptacle or to the ground mat 104. Each of the first end and the second end of each spar 108, 110, 112 is engageable with the one of the connectors of the backpack so as to hold the spars 108, 110, 112 in an erect position projecting above the ground mat 104 when the ground mat 104 lies on flat ground.

To this end, a plurality of connectors is disposed on the receptacle or the ground mat 104, as may be appropriate. These connectors may take a female form such as a hole or eye, or pocket, for accepting insertion of one end of one of the spars. Alternatively, the connectors may take a male form, such as a stud. Either a hole or a stud may be threaded if desired, although other arrangements are possible. Successful engagement of a connector may rely on friction fit, clips, snap hooks, hook and loop material, or may take other forms. Although threaded fasteners (not shown) may be employed if desired, it would also be possible to rely on resilience of the first spar 108, which may display a tendency to assume a straight configuration if not confined by attachment to the frame 116, corresponding structure of the backpack system 100 at the opposite end thereof, and to the clamp 114. If resiliency is relied upon, the first spar 108 may terminate in small fingers (not shown) at either end, which are caused to penetrate corresponding close fitting holes formed in the frame 116 and corresponding structure at the opposite end.

Once the backpack system 100 is disassembled and the spars 108, 110, 112 are separated from the ground mat 104 and from one another, all of the spars 108, 110, 112 fit within the receptacle of the backpack for stowage.

The frame 116 may be seen to comprise a cross bar 120 and arms 122, 124 which connect the cross bar 120 to a suitable sturdy member (not shown) at the end of the ground mat 104. Such a sturdy member may be for example another cross bar which is fixed along its length to the fabric or other significant member of the ground mat 104.

A forward arm 126 may project upwardly from the cross bar 120 at an acute angle to the ground. Preferably, apart from the forward arm 126, the frame 116 lies essentially parallel to the plane occupied by the ground mat 104 when the ground mat 104 lies on flat ground. The forward arm 126 may have a hole (for use with spars 110 terminating in small fingers, not visible in FIG. 1) or other structure for receiving and releasably anchoring the end of the spar 110.

The clamp 114 may be a multipiece device, such as comprising two or three complementing sections which may be joined in any suitable way, such as by threading. For example, the uppermost component of the clamp 114 may comprise a threaded shaft projecting from a circular head, which threads to a threaded hole formed in a lower component of the clamp 114. The lower component of the clamp 114 may have troughs or passages formed therein and adapted to hold the spars 108, 110, 112 in appropriate positions to enable the ends of the spars 108, 110, 112 to align with their respective anchorage points. The separate components of the clamp 114 are not per se critical to the invention and are not specifically shown.

The second spar 110, which in FIG. 1 is parallel to the longitudinal axis of the ground mat 104, may be anchored at one end at the forward arm 126, and at the opposed end at an anchor tab 142. The anchor tab 142 may have a pocket for receiving one end of the second spar 110 for example. Thus, the first spar 108, second spar 110, and third spar 112 are all held as shown in FIG. 1 when the backpack system 100 is assembled as shown in FIG. 1.

The head end 144 of the backpack system 100 may be anchored to the ground by a system employing a connector strap 128. The connector strap 128 is shown drawn to enlarged scale in FIG. 2. The connector strap 128 may comprise a strip of rugged polymeric material, adapted to comprise a pocket 130, a second pocket 132, an open loop 134, and a fastener such as a snap 136. The snap 136 may be utilized to connect the connector strap 128 to a sturdy component of the ground mat 104. Alternatively, the connector strap 128 may be integrated with the ground mat by making it integral with a sturdy component of the ground mat 104 (this option is not shown). The pockets 130, 132 are closed at their distal ends so that elongated members such as the end of one arm 138 of a bracket or frame (not shown) forming a structural component at the head end 144 of the backpack system inserted therein cannot escape. By contrast, the open loop 122 is open at both ends, so that a member such as an anchor strip 146 passes entirely through the open loop, as indicated by an arrow 152. The anchor strip 146 may bear holes 148, 150 to accommodate headed pins (not shown) which may be driven into soft ground to help keep the ground mat 104 from moving along the ground should occupants move about in the course of sleeping for example.

The ground mat 104 has a distal end located opposite the head end 144 along the length of the ground mat 104. The rigid frame 116 projects from this distal end. The second ends of the spars 108, 110, 112 are all anchored to the rigid frame 116 at three of the connectors when the backpack system 100 is assembled in the second configuration as a tent. The spar 110 may be anchored at its first end to a member of the receptacle such as a flaccid flap 143 by the anchor tab 142. At its second end, the spar 110 may be anchored to the forward arm 126.

The backpack 102 may play various roles in assembly of the backpack system 100. For example, the anchor tab 142 may be part of the backpack 102. Also, the backpack 102 may have a strip 144 bearing snaps 146, which connect to corresponding snaps (not visible) provided on the ground mat 104. In the implementation of the invention of FIG. 1, the backpack 102 becomes a link in that structure holding the two ends of the second spar 110.

Figure 2:
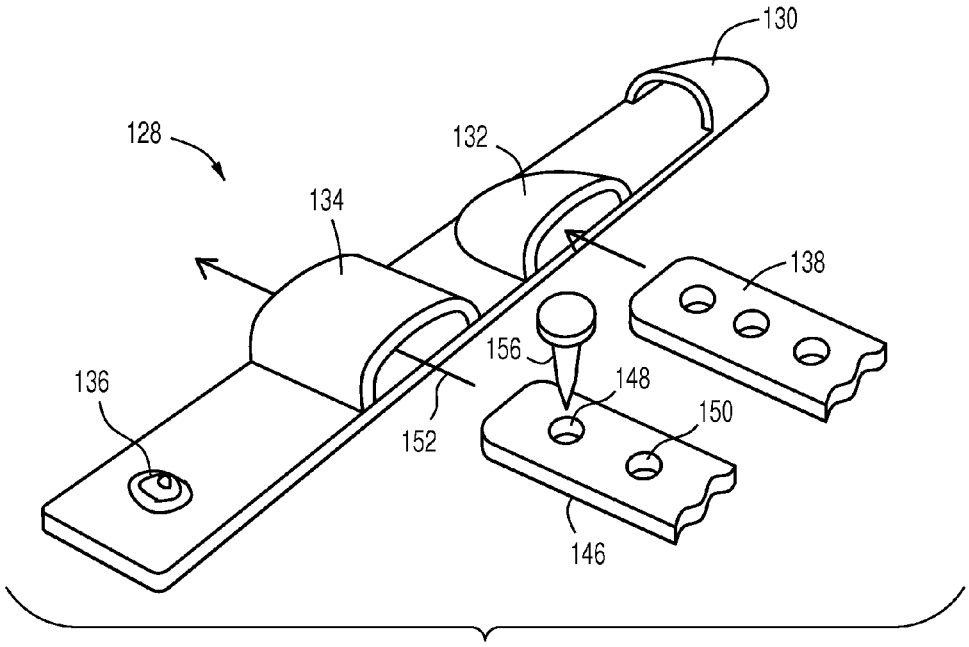
FIG. 2 is an enlarged perspective detail view of a component seen towards the bottom right of FIG. 1.

FIGS. 1 and 2 also show how the anchor strip 146 is used. The anchor strip 126 has holes (such as the holes 148, 150 seen in greater scale in FIG. 2) for receiving a fastener such as a nail 156 (see FIG. 2). The nail 156 may be typical of several nails which may be used to stabilize the ground mat 104. The nails are to be driven into the ground, and once so driven, pin their associated anchor strips against the ground.

In FIG. 1, the spar 110 is seen to comprise three manually separable, serially connectable sections or segments 158, 160, 162 which may be joined serially by a frictional arrangement such as one using a peg which fits into a socket, for example. Of course, any or all of the spars 108, 110, 112 may be so formed. Alternatively, the spars 108, 110, 112 may each comprise only one section if desired.

Figure 3:
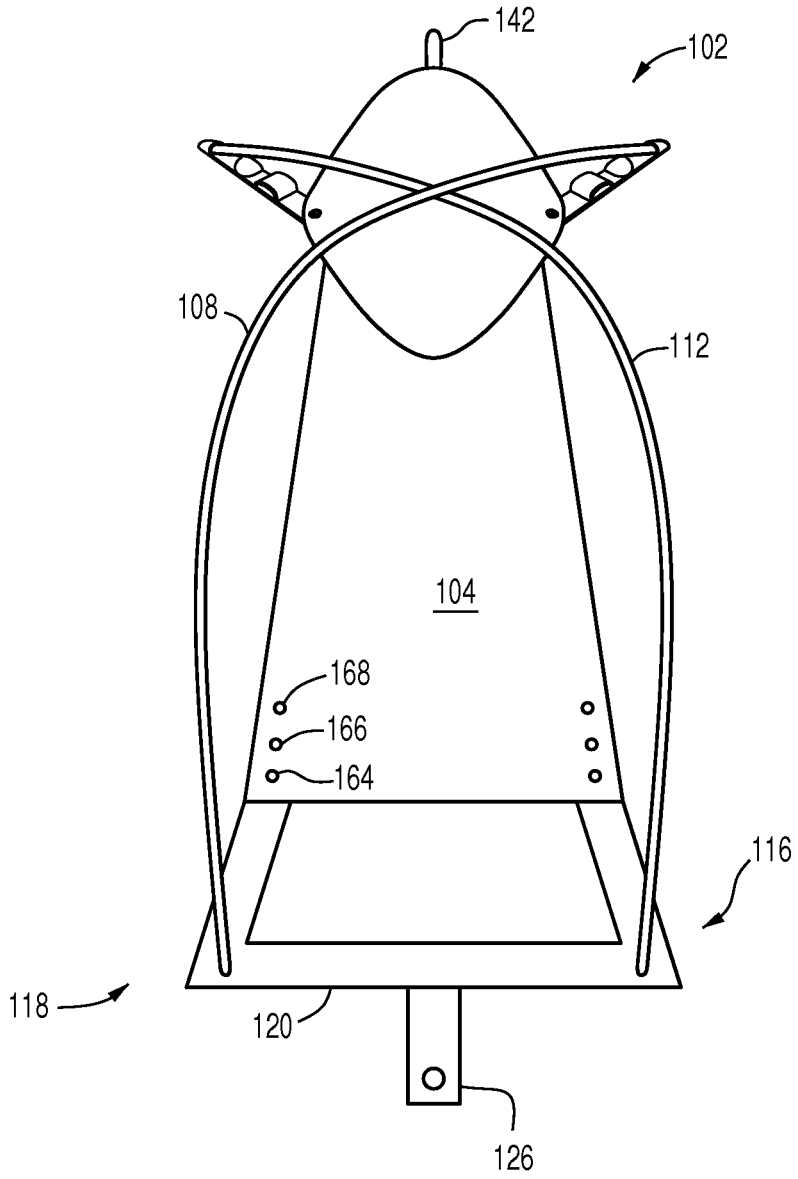
FIG. 3 is a front perspective view of FIG. 1, with some components omitted for clarity of the view.

FIG. 3 provides a frontal perspective view for further elucidation of assembly, but with the second spar 110 removed for clarity of the view.

Turning now to FIG. 4, the backpack 102 may be in many ways typical of backpacks. The backpack 102 may comprise a floor 168, a generally flaccid upstanding peripheral wall 170, and a closure flap 172, all of which combine to define a receptacle 174 when the closure flap 172 is fixed along the upper edge of the peripheral wall 170. The closure flap 172 may be fixed by a zipper (not shown) for example, as is conventional with many backpacks. The backpack 102 may have two arm straps 176, 178 for encircling the arms of the user when the backpack 102 is worn on the back.

FIG. 5 shows a fabric tent member 180 mounted to the skeletal frame 106 (see FIG. 1; the skeletal frame 106 is concealed in FIG. 5). The outer configuration of the fabric tent member 180 is seen to reflect engagement with the first spar 108, the second spar 110, and the third spar 112 by close cooperation therewith. This cooperation is seen as creases 182, 184 formed in the fabric tent member 180, which is somewhat tautly draped over the skeletal frame 106. Once mounted to the skeletal frame 106, an occupiable space is defined inside the fabric tent member 180, above the ground mat 104.

The lower edges of the fabric tent member 180, such as the lower edge 186, may be fastened to the ground mat 104 by snaps (not visible in FIG. 5, but which may be similar to the snaps 164, 166, 168 seen in FIG. 3. Snap connection provided by the snaps may be of sufficient numbers and spacing so as to eliminate gaps which would otherwise occur between the fabric tent member 180 and the ground mat 104.

FIG. 5 shows the second spar 110 disconnected from the anchor tab 142. The second spar 110 may remain in the position shown in FIG. 5 due to tension of the fabric tent member 180.

Figure 6:
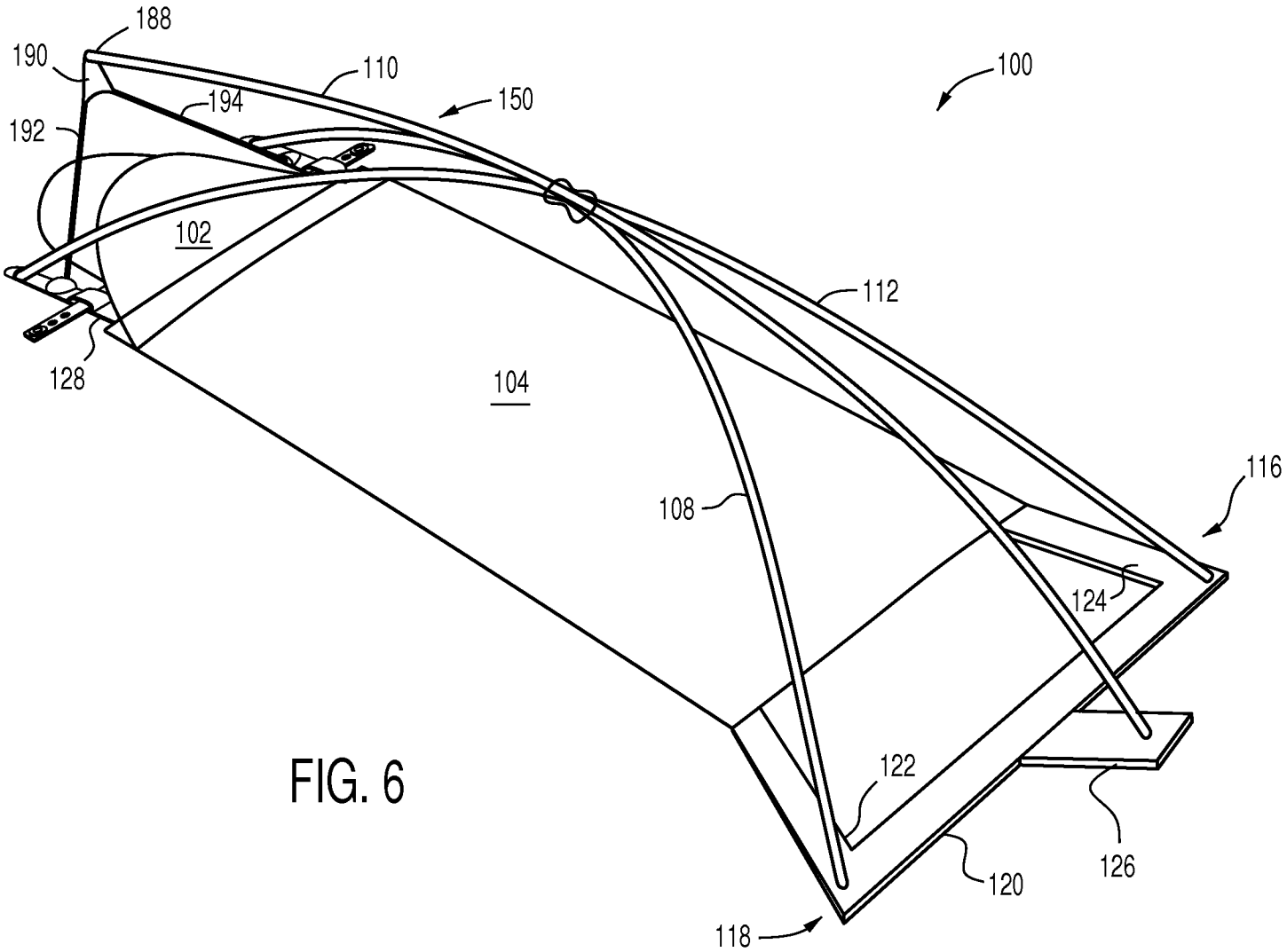
FIG. 6 is a perspective view of a backpack system according to a further aspect of the invention.

FIG. 6 shows an arrangement wherein the distal end 188 of the second spar 110 is held by a connector tab 190 mounted to two flexible cord-like tethers 192, 194. In this implementation of the invention, the anchor tab 142 is not used. It will be seen in FIG. 6 that the distal end 188 of the second spar 110 is located well above the ground mat 104. This enables an occupant of the tent of the backpack system 100 to peer out from the tent.

Figure 7:
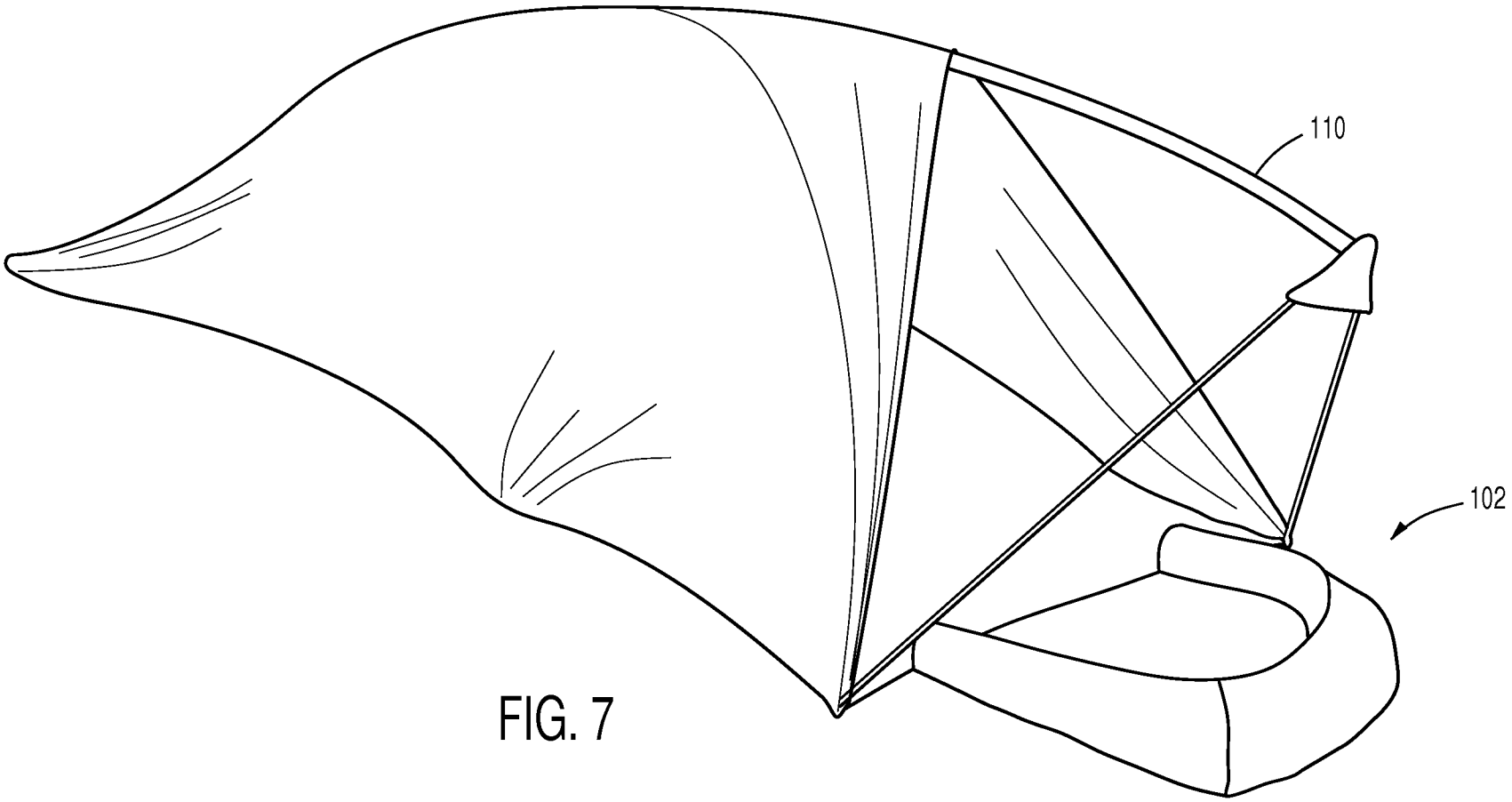
FIG. 7 is a perspective view of the backpack system of FIG. 6, but showing a tent member installed.

FIG. 7 shows how the fabric tent member 180 may be pulled away from the distal end 188 of the second spar 110 to increase the size of the opening of the tent.

Figure 8:
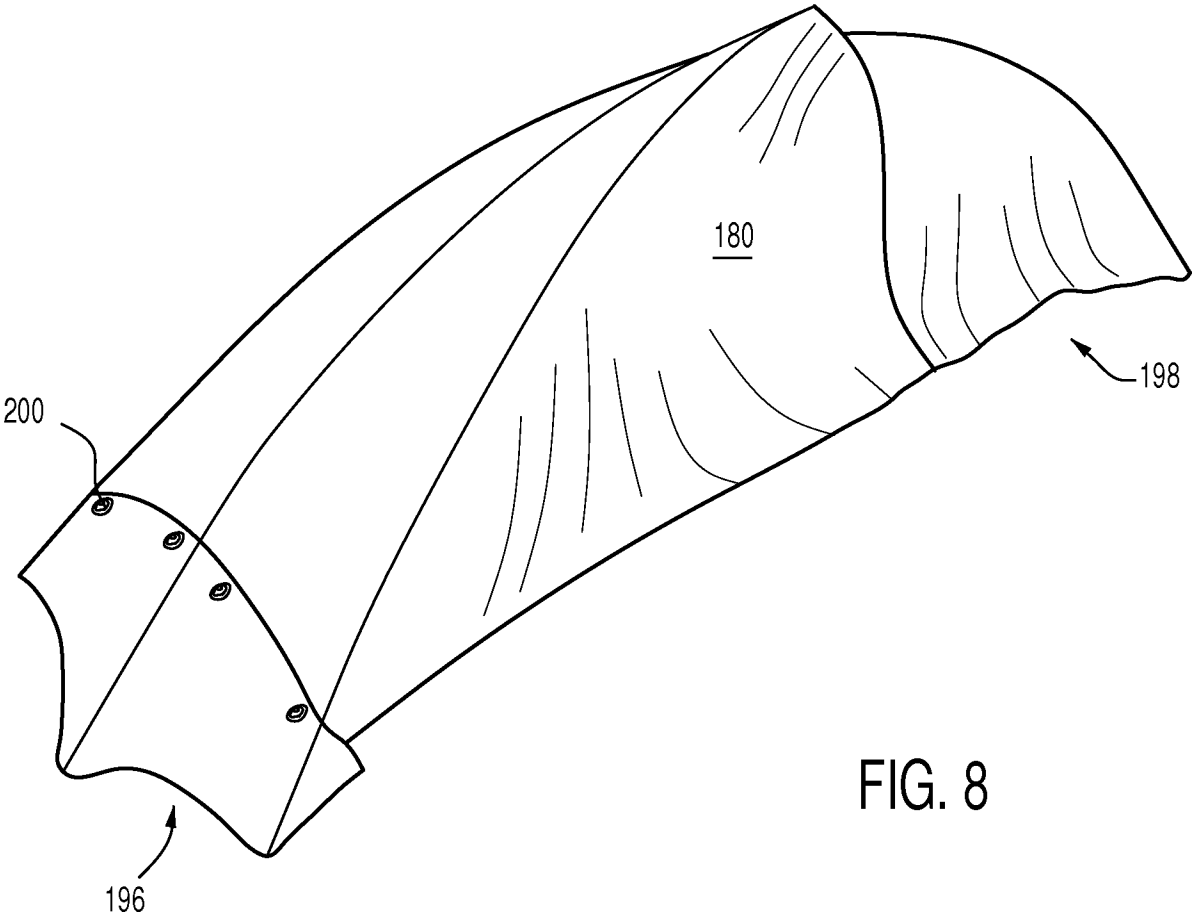
FIG. 8 is a perspective view of a backpack system according to a still further aspect of the invention.

FIG. 8 shows how the tent of the backpack system 100 may be fully sealed. A panel 196 may seal one end of the tent, while a panel 198 may seal the opposite end of the tent. The panels 196, 198 may be formed integrally with the fabric tent member 180, or may be separate components which are attachable to the fabric tent member 180 such as by snaps 200.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A backpack system which is convertible between a first configuration serving as a backpack and a second configuration serving as a tent, comprising:

a backpack comprising a receptacle further comprising a plurality of flaccid walls including a ground mat which is disposed to be assembled to lie flat on flat ground to form the tent in the second configuration, and a plurality of connectors disposed on the receptacle, wherein the ground mat has a head end and a distal end located opposite the head end along the length of the ground mat, and the ground mat comprises a rigid frame projecting from the distal end, a knock-down skeletal frame comprising at least a first spar and a second spar each of which comprises a first end and a second end and forms an arc when the first end and the second end of the spar are fixed to the receptacle, wherein once separated, all of the spars fit within the receptacle of the backpack, and wherein each end of each one of the spars is engageable with the one of the connectors of the backpack so as to hold the spars in an erect position projecting above the ground mat when the ground mat lies on flat ground, wherein the rigid frame comprises a forward arm projecting from the frame in a direction away from the head end of the ground mat, and the first spar is anchored at its first end to a flaccid flap which is part of the receptacle, and at its second end is anchored to the forward arm; and a third spar which comprises a first end and a second end and forms an arc when the first end and the second end of the spar are fixed to the receptacle, wherein the first spar, the second spar, and the third spar each form an arc when the first end and the second end of the spar of each one of the first spar, the second spar, and the third spar are fixed to the receptacle in respective operative positions, and the first spar, the second spar, and the third spar cross one another at a common point at the maximum height of each of the first spar, the second spar, and the third spar, and further wherein the backpack system comprises a fastener which engages the first spar, the second spar, and the third spar where they cross one another; and the second end of the first spar, the second spar, and the third spar are all anchored to the rigid frame at three of the connectors when the backpack system is assembled in the second configuration as a tent.

2. The backpack system of claim 1, wherein the floor mat has a longitudinal axis, the first spar occupies a plane which generally intersects the longitudinal axis of the ground mat when the first spar is in its operative position fixed to the receptacle at its first end and at its second end.

3. The backpack system of claim 2, wherein the second spar and the third spar are connected at their respective first end and second end at corners of the ground mat.

4. The backpack system of claim 1, wherein at least one of the first spar, the second spar, and the third spar comprises a plurality of manually separable, serially connectable sections.

5. The backpack system of claim 1, wherein each one of the first spar, the second spar, and the third spar comprise a plurality of manually separable, serially connectable sections.

6. The backpack system of claim 1, wherein the ground mat is manually connectable to and removable from the backpack.

7. The backpack system of claim 1, further comprising a fabric tent member which engages the first spar, the second spar, and the third spar such that an occupiable space is defined inside the fabric tent member, and the fabric tent member fits in close cooperation with the first spar, the second spar, and the third spar.

* * * * *